United States Patent [19]

Furzer

[11] 4,169,447

[45] Oct. 2, 1979

[54] STARTING SYSTEM FOR COMPRESSION IGNITION ENGINE

[75] Inventor: Roy G. R. Furzer, Willowdale, Canada

[73] Assignee: Diesel Equipment Ltd., Toronto, Canada

[21] Appl. No.: 822,554

[22] Filed: Aug. 8, 1977

[51] Int. Cl.[2] ..... F02N 17/00

[52] U.S. Cl. ..... 123/179 E; 74/7 R

[58] Field of Search ..... 123/179 R, 179 E; 74/7 R; 290/4 R, 4 C

[56] References Cited

U.S. PATENT DOCUMENTS

| | | | |
|---|---|---|---|
| 1,182,531 | 5/1916 | Doman | 123/179 E |
| 1,356,065 | 10/1920 | Heinze | 123/179 E |
| 2,070,615 | 2/1937 | Plante | 123/179 E |
| 2,095,236 | 10/1937 | Baer | 123/179 E |
| 2,123,711 | 7/1938 | Callsen | 123/179 E |
| 3,176,525 | 4/1965 | Rose | 74/7 R |
| 3,690,188 | 9/1972 | McMillen | 74/7 R |
| 3,991,734 | 11/1976 | Martin | 123/179 E |

FOREIGN PATENT DOCUMENTS

| | | | |
|---|---|---|---|
| 684993 | 11/1939 | Fed. Rep. of Germany . | |
| 883677 | 5/1950 | Fed. Rep. of Germany | 123/179 E |
| 567954 | 3/1945 | United Kingdom | 123/179 E |

*Primary Examiner*—Charles J. Myhre
*Assistant Examiner*—David D. Reynolds
*Attorney, Agent, or Firm*—Ridout & Maybee

[57] ABSTRACT

A starting system for a compression ignition engine includes an auxiliary engine in combination with a conventional cranking motor arranged so that either the auxiliary engine or the cranking motor may be used for starting, or both may be used in tandem. When the auxiliary engine is selected torque is transmitted therefrom to the main shaft of the cranking motor through a transmission including an epicyclic reduction gear train and a releasable clutch. The auxiliary engine is started from the cranking motor through a Bendix drive mechanism driven from a sprag gear which is in constant sliding mesh with a drive gear of the cranking motor and connected to the Bendix drive mechanism by a cushion spring.

5 Claims, 1 Drawing Figure

STARTING SYSTEM FOR COMPRESSION IGNITION ENGINE

Figure 1:
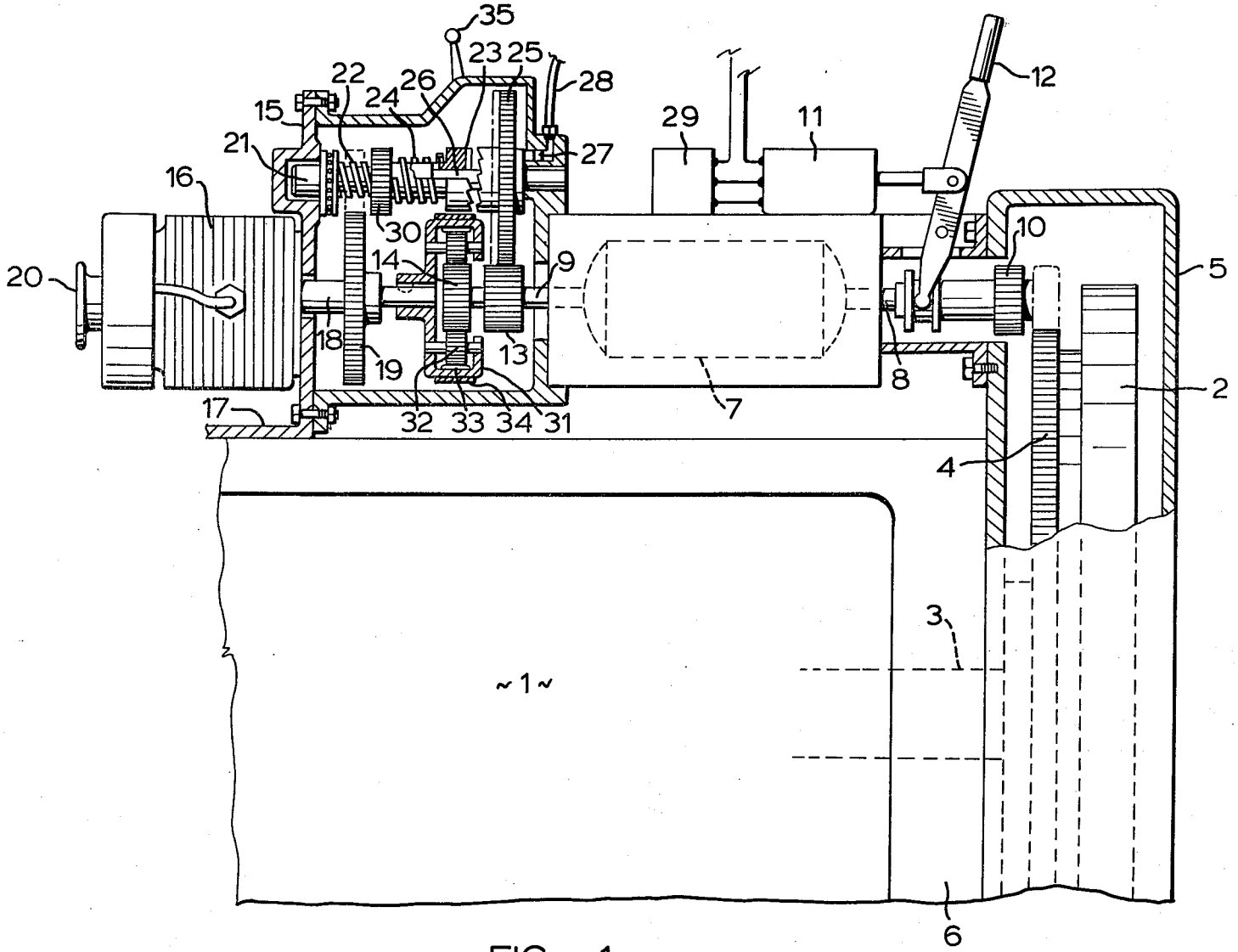

This invention relates to a system for starting internal combustion engines of the compression ignition type.

Such engines are generally started by means of a cranking motor, the main shaft of which is adapted to be coupled to the engine crankshaft by an automatic clutch; the cranking motor may be either an electric or a compressed air motor. However, in cold weather conditions compression ignition engines are difficult to start; a low temperatures it is generally necessary to apply a starting torque which is beyond the capability of commercially available electric starting motors, and for a period which is beyond the capacity of compressed air starting motors. It is known to use auxiliary internal combustion engines for starting purposes in certain cases, but this method is highly inconvenient. It is therefore not used in cases where alternative methods are available, or where the main engine may have to be restarted at relatively frequent intervals. For this reason it would be quite impracticable to rely upon the use of auxiliary starter engines in diesel trucks.

In U.S. Pat. No. 3,991,734 issued Nov. 16, 1976 to John C. Martin and entitled "Starting System for Internal Combustion Engines of the Compression Ignition Type", there is described a simple, portable system which is versatile, and which is particularly suitable for the starting of diesel trucks which have to operate under a wide range of conditions. Basically, the starting system described in U.S. Pat. No. 3,991,734 provides an auxiliary engine which can be used to assist the conventional cranking motor for starting the main engine, or to supply all the starting torque when necessary, the auxiliary engine being coupled, when required, to the main shaft of the cranking motor through a releasable clutch for driving the main shaft through reduction gearing. While this system represents a substantial advance in the art, however, furnishing a solution to a problem which had long been outstanding, it has the limitation that it is not feasible to start the auxiliary engine from the cranking motor under cold weather conditions as the starting torque would need to be applied through an overdrive. Accordingly, it has been found necessary to provide a separate starting motor for the auxiliary engine.

The present invention relates specifically to an improvement in the system described in the above patent, the improvement being the provision of a transmission system connected between the main shaft of the cranking motor and the crankshaft of the auxiliary engine for starting the auxiliary engine from the cranking motor and so eliminating the need for a separate starting motor. The transmission system includes a layshaft having a sprag mounted thereon and connected to the layshaft by a cushion spring, a sprag gear in constant sliding mesh with an output gear of the cranking motor, the sprag gear being normally biassed out of engagement with the sprag gear and being displaceable against its bias into driving engagement with the sprag, and a Bendix drive comprising a helically threaded portion of the layshaft and a pinion rotatably mounted thereon, the pinion being axially displaceable in response to rotation of the layshaft into meshing engagement with a starter gear of the auxiliary engine, and being disengageable therefrom in response to reverse rotation of the layshaft upon starting of the auxiliary engine.

The invention will now be described by way of example with reference to the accompanying drawing, which is a part-sectional diagrammatic view of an engine starting system according to the invention.

Referring to the drawing, a compression ignition engine 1 is shown with a conventional flywheel 2 mounted on the crankshaft 3 of the engine. The flywheel 2 carries a conventional starter gear 4. A flywheel housing 5 is mounted on the rear of the engine crankshaft housing 6, on which a conventional cranking motor 7 is mounted. The cranking motor 7, which may be an electric or a compressed air motor, has a mainshaft providing first and second shaft extensions 8, 9, extending coaxially with one another from opposite ends of the motor, the first shaft extension 8 carrying a pinion gear 10 which is actuated in known manner so as to engage the starter gear 4 for cranking the engine 1. The pinion gear 10 is axially controlled by a solenoid 11 which provides positive drive pinion engagement before cranking. The solenoid is a special low voltage output unit permitting reduced speed rotation of the cranking motor without engagement of the pinion gear. A lever 12 provides for manual engagement of the pinion gear 10 in the event of there being a complete absence of electric power to energize the solenoid.

On the second shaft extension 9 of the cranking motor, and rotatable therewith, are a drive gear 13 and the sun gear 14 of an epicyclic gear train, these being enclosed, together with first and second transmission means as hereinafter described, in an adaptor housing 15 which is mounted between the cranking motor 7 and a small auxiliary engine 16. A simple outrigger support 17 is incorporated to mount, align and carry the reaction from the auxiliary engine 16. The auxiliary engine is, preferably, a two-stroke internal combustion engine of the spark ignition type, having a crankshaft 18 with a starter gear 19 at one end; at the other end of the crankshaft 18 a simple rope start pulley 20 is mounted.

The first transmission means referred to above is connected between the mainshaft of the cranking motor 7 and the crankshaft 18 of the auxiliary engine 16 for the purpose of starting the auxiliary engine, when necessary, from the cranking motor. This comprises a layshaft 21, a portion 22 of which is helically threaded and forms part of a Bendix drive. A sprag 23 is mounted on the layshaft and is connected to it by a helical cushion spring 24. A sprag gear 25 in constant sliding mesh with the drive gear 13 is engageable with the sprag 23, but is normally biassed out of engagement with the sprag by a spring and thrust race 26. The sprag gear can be displaced against the spring bias by means of a plunger 27 actuated by hydraulic pressure applied by a pipe 28 to one side of the plunger in accordance with the opening of a driver-controlled valve. When the sprag gear is brought into engagement with the sprag 23, hydraulic pressure in the pipe 28 operates a switch to energize a solenoid 29, which actuates the cranking motor 7. Torque is thus applied to the layshaft 21 via the drive gear 13, sprag gear 25, sprag 23 and cushion spring 24. A pinion 30 rotatably mounted on the helically threaded portion 24 of the layshaft is axially displaceable thereon in response to rotation of the layshaft and is brought into meshing engagement with the starter gear 19 of the auxiliary engine 16. Thus torque is transmitted to the auxiliary engine for starting the latter. However, the pinion 30 is rapidly disengaged from the starter gear in response to reverse rotation of the layshaft upon starting of the auxiliary engine.

The second transmission means referred to above, for driving the mainshaft of the cranking motor from the auxiliary engine, comprises essentially an epicyclic gear train engageable with the sun gear 14 and carried by a planet carrier 31 which is mounted on and rotatable with the crankshaft 18 of the auxiliary engine, and a clutch which is selectively engageable with the epicyclic gear train for coupling and uncoupling the crankshaft 18 to the second shaft extension 9 of the cranking motor. Thus a set of planet gears 32 engaging the sun gear 14 are mounted in the planet carrier 31 which is at one end of the crankshaft 18. The planet gears 32 engage an internal ring gear 33 inside the planet carrier, and a brake band 34 engaging the drum of the planet carrier is actuated by a lever 35 pivotally mounted on the adaptor housing 15 for locking the planet gears 32 and thereby clutching the auxiliary engine shaft 18 to the mainshaft of the cranking motor via the sun gear.

Under normal circumstances the diesel engine 1 can be started in the conventional manner using the cranking motor 7 supplied with D.C. power fed from a storage battery through the solenoid 29 in known manner. Under these conditions the cranking motor is completely isolated from the auxiliary engine 16 via the free-wheeling planetary drive 14, 31, 32, thus permitting the system to operate as a normal electric cranking system of the type in common use today.

In circumstances where it would be difficult, or even impossible, to start the diesel engine 1 by conventional means, owing to cold conditions, the small auxiliary engine 16 can easily be started from the cranking motor by connecting the rotational drive therefrom to the starter gear 19 via the sprag gear and Bendix drive; alternatively, where D.C. electric power is not available, the auxiliary engine may be started by hand using the pulley 20. When the auxiliary engine has been started, and with the planetary drive in neutral, the drive pinion 10 is engaged with the ring gear 4 either manually by means of the lever 12 or electrically through solenoid 11, and the lever 35 is operated to lock the planet gears whereby torque is transmitted directly from the auxiliary engine through the mainshaft of the cranking motor to the pinion 10.

What I claim is:

1. A starting system for an internal combustion engine of the compression ignition type, the system comprising a cranking motor having a main shaft, said main shaft providing first and second shaft extensions extending coaxially with one another from opposite ends of the motor, a pinion carried by the first shaft extension and engageable with a starter gear of the engine for starting the engine, a drive gear carried by the second extension and rotatable therewith, a sun gear carried by the second shaft extension and rotatable therewith, an auxiliary engine having a crankshaft and a starter gear thereon, and first and second transmission means connected between the crankshaft of the auxiliary engine and the main shaft of the cranking motor for starting the auxiliary engine from the cranking motor and for driving said main shaft of the cranking motor from the auxiliary engine, respectively, said first transmission means comprising (i) a layshaft having a sprag mounted thereon and connected to the layshaft by a cushion spring, (ii) a sprag gear in constant sliding mesh with said drive gear, the sprag gear being engageable with the sprag and being normally biassed out of engagement therewith, (iii) means for displacing the sprag gear against its bias into driving engagement with the sprag, (iv) means for starting the cranking motor, (v) a Bendix drive comprising a helically threaded portion of said layshaft and a pinion rotatably mounted thereon, said pinion being axially displaceable in response to rotation of the layshaft into meshing engagement with the starter gear of the auxiliary engine, and being disengageable therefrom in response to reverse rotation of the layshaft upon starting of the auxiliary engine, and said second transmission means comprising (i) an epicyclic gear train engageable with said sun gear the epicyclic gear train being carried by a planet carrier rotatable with the crankshaft of the auxiliary engine, and (ii) a clutch selectively engageable with said epicyclic gear train for coupling and uncoupling said crankshaft of the auxiliary engine to and from the second shaft extension of the cranking motor.

2. A starting system according to claim 1, wherein the auxiliary engine is an internal combustion engine of the spark ignition type.

3. A starting system according to claim 2, wherein the cranking motor is a compressed air motor.

4. A starting system according to claim 2, wherein the cranking motor is an electric motor.

5. A starting system for an internal combustion engine of the compression ignition type, the system comprising a cranking motor having a main shaft, said main shaft providing first and second shaft extensions extending coaxially with one another from opposite ends of the motor, a pinion carried by the first shaft extension and engageable with a starter gear of the engine for starting the engine, a drive gear carried by the second shaft extension and rotatable therewith, a sun gear carried by the second shaft extension and rotatable therewith, an auxiliary engine having a crankshaft and a starter gear thereon, and first and second transmission means connected between the crankshaft of the auxiliary engine and the main shaft of the cranking motor for starting the auxiliary engine from the cranking motor and for driving said main shaft of the cranking motor from the auxiliary engine, respectively, said first transmission means comprising (i) a layshaft having a sprag mounted thereon and connected to the layshaft by a cushion spring, (ii) a sprag gear in constant sliding mesh with said drive gear, the sprag gear being engageable with the sprag and being normally biassed out of engagement therewith, (iii) hydraulic means selectively operable for displacing the sprag gear against its bias into driving engagement with the sprag, (iv) electrical starting means responsive to operation of said hydraulic means for starting the cranking motor, (v) a Bendix drive comprising a helically threaded portion of said layshaft and a pinion rotatably mounted thereon, said pinion being axially displaceable in response to rotation of the layshaft into meshing engagement with the starter gear of the auxiliary engine, and being disengageable therefrom in response to reverse rotation of the layshaft upon the starting of the auxiliary engine, and said second transmission means comprising (i) an epicyclic gear train engageable with said sun gear the epicyclic gear train being carried by a planet carrier rotatable with the crankshaft of the auxiliary engine, and (ii) a clutch selectively engageable with said epicyclic gear train for coupling and uncoupling said crankshaft of the auxiliary engine to and from the second shaft extension of the cranking motor.

* * * * *